US009220657B2

(12) United States Patent
Stauber et al.

(10) Patent No.: US 9,220,657 B2
(45) Date of Patent: Dec. 29, 2015

(54) WATER INGRESS DETECTION SYSTEM

(75) Inventors: Joseph L. Stauber, Sheboygan Falls, WI (US); Fred Ogreenc, Cedar Grove, WI (US); Eric Sanders, Howards Grove, WI (US); Jason Seehafer, Sheboygan, WI (US); Richard Kluth, Plymouth, WI (US)

(73) Assignee: KOHLER CO., Kohler, WI (US)

( * ) Notice: Subject to any disclaimer, the term of this patent is extended or adjusted under 35 U.S.C. 154(b) by 597 days.

(21) Appl. No.: 13/618,797

(22) Filed: Sep. 14, 2012

(65) Prior Publication Data

US 2013/0340158 A1 Dec. 26, 2013

Related U.S. Application Data

(60) Provisional application No. 61/661,905, filed on Jun. 20, 2012.

(51) Int. Cl.
*A47K 3/00* (2006.01)
*A61H 33/00* (2006.01)

(52) U.S. Cl.
CPC ..... *A61H 33/005* (2013.01); *A61H 2033/0054* (2013.01); *A61H 2201/0184* (2013.01); *A61H 2201/5043* (2013.01); *A61H 2201/5097* (2013.01)

(58) Field of Classification Search
CPC ..... A61H 33/0087
USPC ..... 4/538–595
See application file for complete search history.

(56) References Cited

U.S. PATENT DOCUMENTS

| | | | |
|---|---|---|---|
| 5,974,602 | A | 11/1999 | Theander |
| 6,405,387 | B1 | 6/2002 | Barnes |
| 6,523,192 | B1 | 2/2003 | Gloodt |
| 6,920,653 | B2 | 7/2005 | Selover |
| 6,971,125 | B2 | 12/2005 | Mattson, Jr. et al. |
| 7,203,977 | B2 | 4/2007 | Mattson, Jr. et al. |
| 2005/0045621 | A1 | 3/2005 | Chenier et al. |
| 2006/0053546 | A1 | 3/2006 | Gloodt |
| 2006/0236444 | A1 | 10/2006 | Selover |
| 2007/0186339 | A1 | 8/2007 | Mattson, Jr. et al. |
| 2008/0028512 | A1 | 2/2008 | Hughson |
| 2009/0158518 | A1 | 6/2009 | Southon et al. |

FOREIGN PATENT DOCUMENTS

| | | |
|---|---|---|
| DE | 3347520 | 7/1985 |

OTHER PUBLICATIONS

Chinese First Office Action dated Sep. 3, 2014 for Application No. 201310241935.4 (14 pgs.).
Extended European Search Report regarding Application No. 13172828.9 (dated Aug. 22, 2013).

*Primary Examiner* — Lori Baker
(74) *Attorney, Agent, or Firm* — Foley & Lardner LLP

(57) ABSTRACT

A detection system for a tub having a water recirculation system includes an electronic sensor and an indicator. The electronic sensor is configured to detect a condition indicative of water being present in a water recirculation system of a tub. The indicator is configured to provide a visual indication according to the detected condition.

24 Claims, 2 Drawing Sheets

WATER INGRESS DETECTION SYSTEM

CROSS-REFERENCE TO RELATED APPLICATIONS

The present application claims the benefit of and priority to U.S. Provisional Patent Application No. 61/661,905, filed on Jun. 20, 2012, the entire disclosure of which is incorporated herein by reference.

BACKGROUND

Many bathing tubs, such as whirlpools, have water recirculation systems. These water recirculation systems generally include a pump, a series of recirculation lines or tubing (i.e., a harness), and one or more outlets or jets, which collectively function to draw water from inside a basin of the tub and expel this water back into the tub. During use, however, the components of the water recirculation system are exposed to water from the tub, which may include bacteria, dirt, and the like from a bather and which remain in the harness or other components of the recirculation system after use. To clean the water recirculation systems, the tub basin is at least partially filled with water, cleaning fluid is added to the water, and the recirculation system is cleaned after which the tub is drained and rinsed.

At hotels and other facilities where whirlpool tubs are used by different visitors, tubs and their recirculation systems are often cleaned daily or before receiving each new visitor, regardless of whether the tub and/or recirculation has actually been used. However, because this practice of cleaning daily or between guests does not take into account actual usage or cleanliness of the tub or recirculation system, the tub and recirculation system may be cleaned unnecessarily. Therefore, significant time, labor, cost, and water may be wasted with each cleaning.

Accordingly, it would be advantageous to provide a system for better identifying actual use of a tub or exposure of a recirculation system to water for determining when the tub and/or water recirculation system should be cleaned.

SUMMARY

According to an exemplary embodiment, a detection system for a tub having a water recirculation system includes an electronic sensor and an indicator. The electronic sensor is configured to detect a condition indicative of water being present in a water recirculation system of a tub. The indicator is configured to provide a visual indication according to the detected condition.

According to an exemplary embodiment, a tub includes a basin, a water recirculation system, and a detection system. The basin is configured to hold water. The water recirculation system is configured to draw water from the basin and expel that water back into the basin. The detection system includes an electronic sensor and an indicator. The electronic sensor is configured to detect a condition indicative of water being present in a water recirculation system of a tub. The indicator is configured to provide a visual indication according to the detected condition.

According to an exemplary embodiment, a method for indicating a state of a water recirculation system of one or more tubs is provided. The method includes detecting with an electronic sensor the presence of water in a water recirculation system of a tub. The method also includes providing at least one visual indication that water has been detected in the water recirculation system by the electronic sensor.

DETAILED DESCRIPTION

Figure 1:
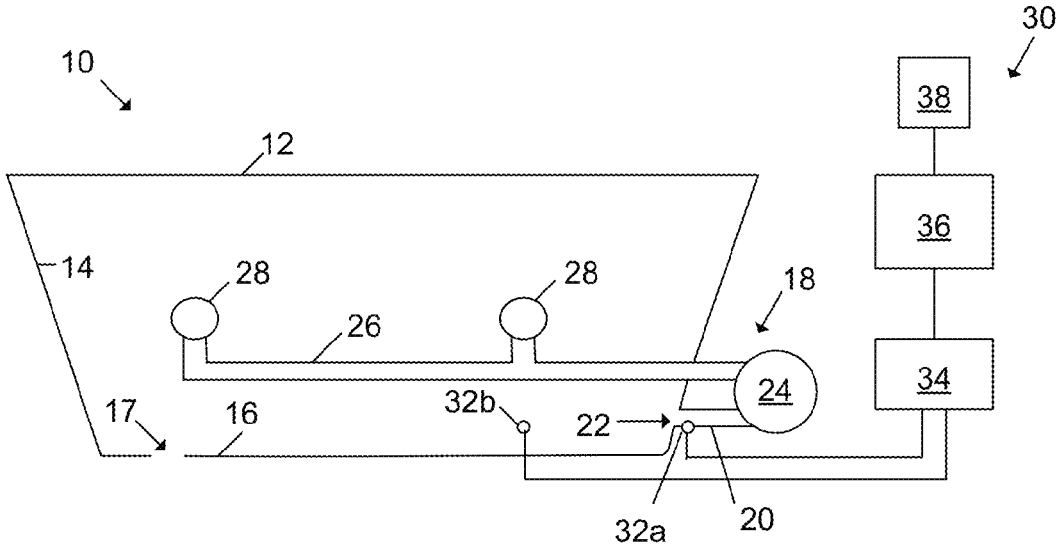
FIG. 1 is a schematic drawing of a tub having a recirculation system and a detection system according to an exemplary embodiment.

Referring to FIG. 1, a whirlpool tub 10 having a usage detection system 30 is shown according to an exemplary embodiment. The tub 10 includes a basin 12 which is defined by sidewalls 14 that extend upwardly from a base 16 of the tub 10. The basin 12 is configured to receive and hold water such that an individual may sit or rest in the basin 12 and take a bath. A drain 17 is located along the base 16 of the tub 10, such that after use, the water in the basin 12 may be emptied.

According to an exemplary embodiment, the tub 10 includes a recirculation system 18. The recirculation system 18 may be selectively operated to circulate the water in the tub 10, for example, to generate a bubbling or massaging action. The recirculation system 18 generally includes a water inlet line 20 extending from a water intake 22 (e.g., along a sidewall 14 proximate the base 16 of the basin 12) to a pump 24. A water outlet line 26 extends from the pump 24 to one or more jets or water outlets 28 along the sidewalls 14 of the basin 12.

According to an exemplary embodiment, when the basin 12 is filled with water to a level above the water intake 22 and the pump 24 is turned on, the pump 24 draws water from the basin 12 into the water intake 22 and through the water inlet line 20 to the pump 24. The pump 24 then forces this water through the water outlet line 26 to the water outlets 28, which then expel this water back into the basin 12. Collectively, the water inlet line 20 and the water outlet line 26 and/or the intake 22 and outlets may be referred to as a harness.

It should be readily appreciated that the recirculation system 18 shown in FIG. 1 is only illustrative and may be configured in manners other than that shown in FIG. 1. For example, according to other exemplary embodiments, the recirculation system 18 may include more, fewer, or differently-located water inlet lines, water intakes, pumps (or different means for transferring water), water outlet lines, or outlets (e.g., water outlets located along the base 16 or scats of the tub 10). Moreover, the recirculation system 18 may include additional elements that, for example, change the flow pattern of the water (e.g., a variable speed pump or valves) or that heat the water (e.g., heating elements).

According to an exemplary embodiment, the usage detection system 30 is configured to detect conditions that indicate when water has entered the recirculation system 18. Based on the detected condition, the detection system 30 is configured to visually indicate a state of the tub 10 and/or recirculation system 18, such as a usage state (i.e., whether or not the tub 10 and/or recirculation system 18 have been used), or a cleaning state (i.e., whether or not the tub 10 and/or recirculation system require cleaning). For example, the recirculation system may detect whether water is actually present in the recirculation system 18 and/or detect whether water in the basin 12 has reached a predetermined level at which water has likely or necessarily entered the recirculation system 18.

Advantageously, detection of water in these locations provides a more accurate indication of whether water has entered the recirculation system 18 to require cleaning, while generally avoiding being over-inclusive (i.e., resulting in more cleaning than is necessary) and avoiding being under-inclusive (i.e., resulting in less cleaning than is necessary). For example, the detection system 30 avoids being over-inclusive as compared to cleaning on a regular schedule or with each use of the tub, since water may not have entered the recirculation system 18 between recurring cleanings (e.g., if the basin 12 is filled only to a shallow level, or is used only for a shower). The system 30 also avoids being under-inclusive as compared to cleaning only when the recirculation system 18 is operated, since water may have entered the recirculation system 18 even without it being operated (e.g., if a basin 12 is filled for a still bath without activating the recirculation system 18).

According to an exemplary embodiment, the usage detection system 30 includes one or more electronic sensors (e.g., shown as sensors 32*a* and 32*b*), a controller 34 in communication with the sensors 32*a*, 32*b*, an indicator 36 in communication with the controller 34, and a user interface 38 in communication with the controller 34 and/or indicator 36.

According to an exemplary embodiment, the sensors 32*a*, 32*b* are configured for detection of conditions indicative of water having entered into the recirculation system 18. The sensors 32*a*, 32*b* are further configured to send a signal to the controller 34 by wired or wireless communication (i.e., a detection signal) according to the measurement or detected. For ease of description, the sensors 32*a*, 32*b* may be referred to below as "the sensor 32" and it should be understood that the systems described herein may include a single sensor or more than one sensor such as sensor 32*a* and/or sensor 32*b*.

According to an exemplary embodiment, the sensor 32 is a sensor 32*a* that is configured to detect the presence of water in the water recirculation system 18. For example, the sensor 32*a* may be a capacitive sensor located along the water inlet line 20 between the water intake 22 and the pump 24. The sensor 32*a* is configured to measure capacitance of or detect a change in capacitance due to, water present in the inlet line 20 at the location of the sensor 32*a*. According to the measured or detected change in capacitance, the sensor 32*a* sends the detection signal (e.g., a voltage, binary code, etc.) to the controller 34. According to other exemplary embodiments, the sensor 32*a* may be placed at other locations in the harness or recirculation system 18 including, for example, proximate or inside a water outlet 28, proximate or inside the water outlet line 26, proximate or inside the water intake 22, inside the water inlet line 20, in multiple locations, or in any other suitable location within the circulation system.

According to an exemplary embodiment, the sensor 32 is instead, or additionally, a sensor 32*b* that is configured to detect that water has reached a certain level or height within the basin 12 of the tub 10. Detection of water having reached a certain height within the basin 12 provides an indication that water may or must have entered into the recirculation system 18 through an entry point, such as the intake 22 or outlets 28. For example, the sensor 32*b* may be provided at a predetermined level that corresponds to the lowest possible point at which water may enter the recirculation system 18 (i.e., at the level of the water intake 22, or outlet 28 if positioned below the water intake 22). The sensor 32*b* may be attached to or otherwise be incorporated into an interior or exterior surface of the wall 14 of the basin 12. The sensor 32 measures certain characteristics or detects a change in characteristics (e.g., capacitance or other characteristic depending on the sensor type) that indicate water has approached or reached the level or position of the sensor 32. Based on the measurement or detected change, the sensor 32*b* sends a detection signal to the controller 34. According to other exemplary embodiments, the sensor 32*b* may be placed at a predetermined level in the basin 12 that is below the lowest entry point to the recirculation system 18 (e.g., to provide a safety margin, for example, in case water is splashed up into the intake 22). According to still other exemplary embodiments, the sensor 32*b* may be placed at other heights (e.g., at or above an outlet 28, between the intake 22 and outlet 28, or at multiple heights), or in any other suitable location.

According to an exemplary embodiment, the sensor 32 is of a type able to measure values or detect changes in values of various properties (depending on the type of sensor) that indicate the presence of water. For example, as discussed above, the water sensor 32 may be a capacitive sensor which is attached to the outside of the water inlet line 20 and detects a change in capacitance across the water inlet line 20. The capacitive sensor may, for example, be a Flatpack Capacitive Prox Sensor (Part no. C2D45AN1-PX) sold by Stedham Electronics of Reno, Nev. One advantage of a capacitive sensor is that the sensor 32 can be mounted externally around the water inlet line 20 or to a surface of the basin 12, allowing for retrofit applications of the detection system 30 to existing tubs without otherwise modifying an existing tub or recirculation system. According to other exemplary embodiments, the sensor 32 may be of another type, such as ultrasonic, infrared, resistive, optical, temperature, amongst others, as may suitable for detecting properties that may indicate the presence of water. In each case, the sensor 32 is configured to send a signal according to the measured property or detected change in properties. According to other exemplary embodiments, the one or more sensors 32 may be configured in other manners including, for example, providing multiple sensors of different types may be used in conjunction with each other.

According to an exemplary embodiment, the controller 34 is configured to receive the detection signal from the sensor 32 and further receive a signal from the user interface 38 (i.e., a user control signal). The controller 34 may also receive detection signals and user control signals from multiple sensors 32 (associated with one or more tubs 10 and/or water recirculation systems 18) and/or multiple user interfaces 38. The controller 34 is configured to send a signal through wired or wireless communication to the indicator 36 (i.e., an indicator signal) for controlling the indicator 36 according to the detection signal and the user control signal (i.e., based on a determination made by the controller 34 according to simple receipt of or the information contained in the detection signal and/or the user control signal). The controller 34 may, for example, be configured as a device (such as a computing device) having a communication interface (i.e., for receiving the detection signal and user control signal, and also for sending the indication signal), a processor (i.e., for making a determination according to the detection signal and/or user control signal), and include memory (i.e., for storing programming according to which the processor makes a determination and/or for storing information related to the detection and user control signals received and/or indication signals sent). It is noted that use of wireless communication may be particularly advantageous in retrofit applications in which is may be difficult or cost prohibitive to run physical wires between the sensor 32, controller 34, and/or indicator 36. Determination of the indicator signal is discussed in further detail below.

According to an exemplary embodiment, the indicator 36 is configured to receive the indication signal and, according to the indication signal, visually indicate a state or condition of the tub 10 and/or recirculation system 18. The visual indication provided by the indicator 36 may, for example, indicate a usage (i.e., whether the tub 10 and/or recirculation system 18 have been used or operated), a cleaning state (i.e., whether the tub 10 and/or recirculation system 18 have been cleaned, will be cleaned, or need to be cleaned), or other suitable information that may be useful to staff responsible for cleaning or overseeing cleaning of the tub 10 and recirculation system 18.

According to one exemplary embodiment, the indicator 36 is a light located proximate the tub 10, and the controller 34 instructs the light to be illuminated to indicate a usage state or cleaning state (e.g., the light of the indicator 36 is turned on to indicate that the tub 10 and/or recirculation system have been used or require cleaning). According to other exemplary embodiments, the indicator 36 may be configured in other manners including, for example, by being provided in different locations (e.g., in a remote location from the tub), by being a different type (e.g., an alphanumeric display, computer screen, etc.), or by displaying different information (e.g., to communicate alphanumeric characters or flash in a code indicative of detected properties, usage state, cleaning state, or other information).

According to an exemplary embodiment, the user interface 38 is configured to allow a user to change the visual indication provided by the indicator 36. The user interface 38 is configured to receive an input from a user and send a corresponding user control signal to the controller 34. For example, a user may want to change the state of the tub 10 and/or recirculation system 18 indicated by the indicator 36 (e.g., to indicate that cleaning is completed, will be performed, or is required), or request that different information is displayed by the indicator 36. The user interface 38 may, for example, include a switch located near the tub 10 (e.g., a reset switch). The user interface 38 may also be secured to prevent inadvertent or unauthorized use (e.g., a key operated switch, or by behind a locked access point). According to other exemplary embodiments, the user interface 38 is configured in other manners, for example, by providing remote operation of the indicator 36 (e.g., as a wireless key fob, or computer having a keyboard or other input means).

As discussed above, according to an exemplary embodiment, the detection system 30 is configured to determine whether the recirculation system 18 has been used or otherwise requires cleaning and to display a corresponding visual indication or other information to a user. More particularly, the controller 34 determines the usage state, cleaning state, or information to be displayed by the indicator 36 according information received from the sensor 32 and/or user interface 38

According to an exemplary embodiment, the controller 34 receives information from the sensor 32 (i.e., a detection signal) in the form of a binary (e.g., true/false) indication or in the form of a quantified value or measurement.

According to an exemplary embodiment where the detection signal is a binary indication (e.g., a one-time or continuous voltage of a certain magnitude corresponding to a detected threshold value, such as from a tripped switch), the controller 34 may instruct the indicator 36 (i.e., send an indication signal) to provide a binary indication (e.g., to turn on a light of the indicator 36). In this manner, the detection system 30 may provide a visual indication of the usage or cleaning state of the recirculation system 18 (i.e., that the recirculation system 18 has or has not been used, or does or does not require cleaning).

According to an exemplary embodiment where the detection signal is a quantified value or measurement, the controller 34 may have more information according to which it may make a determination for instructing the indicator 36. For example, the detection signal may correspond to an absolute measured value (e.g., capacitance, resistance, temperature, etc.) or quantified change in value relevant to ambient. As compared to binary information, this quantified information may allow the controller 34 to more accurately determine the usage state, cleaning state, or other information to be displayed, such as by avoiding false positives (e.g., if another object causes a change in measured properties but at a different measurement or change than expected for water).

According to an exemplary embodiment, the controller 34 may also be configured to process a sampling of detection signals over a period of time. In this manner, the controller 34 is provided with more information according to which it may more accurately make a determination for instructing the indicator 36. For example, a singular instance of a change in measured or detected properties may not indicate sustained presence of water but may instead indicate an error of the sensor, or may indicate the presence of water or another object for durations that my not require cleaning.

According to an exemplary embodiment, the detection system 30 is configured to utilize stored information for determining the usage state, cleaning state, or other information to be displayed. More particularly, the controller 34 may record information received from the sensor 32 and/or user interface 38 and/or may be preprogrammed with various information. For example, recorded information may include the number of detection signals received, quantified values or measurements, and the frequency and timing of detection signals received. Preprogrammed information may include, for example, configuration of the one or more sensors 32 (e.g., number, type, and placement), configuration of the one or more tubs 10 and/or recirculation systems 18 (e.g., number, size, type, location, etc.).

According to an exemplary embodiment, the detection system 30 is configured to receive user inputs for changing the indicated usage state, cleaning state, or other information. More particularly, the controller 34 is configured to receive information from the user interface 38 (i.e., user control signals) according to user inputs to the user interface 38. For example, user may desire to reset the usage state or cleaning state (e.g., to not used or cleaning not required), the user interface 38 being configured to receive such an input and send a corresponding user control signal to the controller 34, which then instructs the indicator 36 to display a corresponding visual indication (e.g., to turn off a light). According to other exemplary embodiments, other user inputs and/or visual indications may relate to, for example, time of the most recent cleaning, historical usage historical usage and/or cleaning requirements, expected/actual cleaning start time/duration. Such information may be useful, for example, when evaluating guest usage patterns (e.g., whether or not a tub is used, still tub vs. whirlpool usage, usage duration, etc.), evaluating performance of or needs for cleaning staff, and scheduling or prioritizing cleaning. According to still other exemplary embodiments, water detection may be used for purposes other than determining a usage or cleaning state, such as for detecting an over flow condition, a clogged drain, or unexpected usage and providing a corresponding visual indication (e.g., an alarm).

Figure 2:
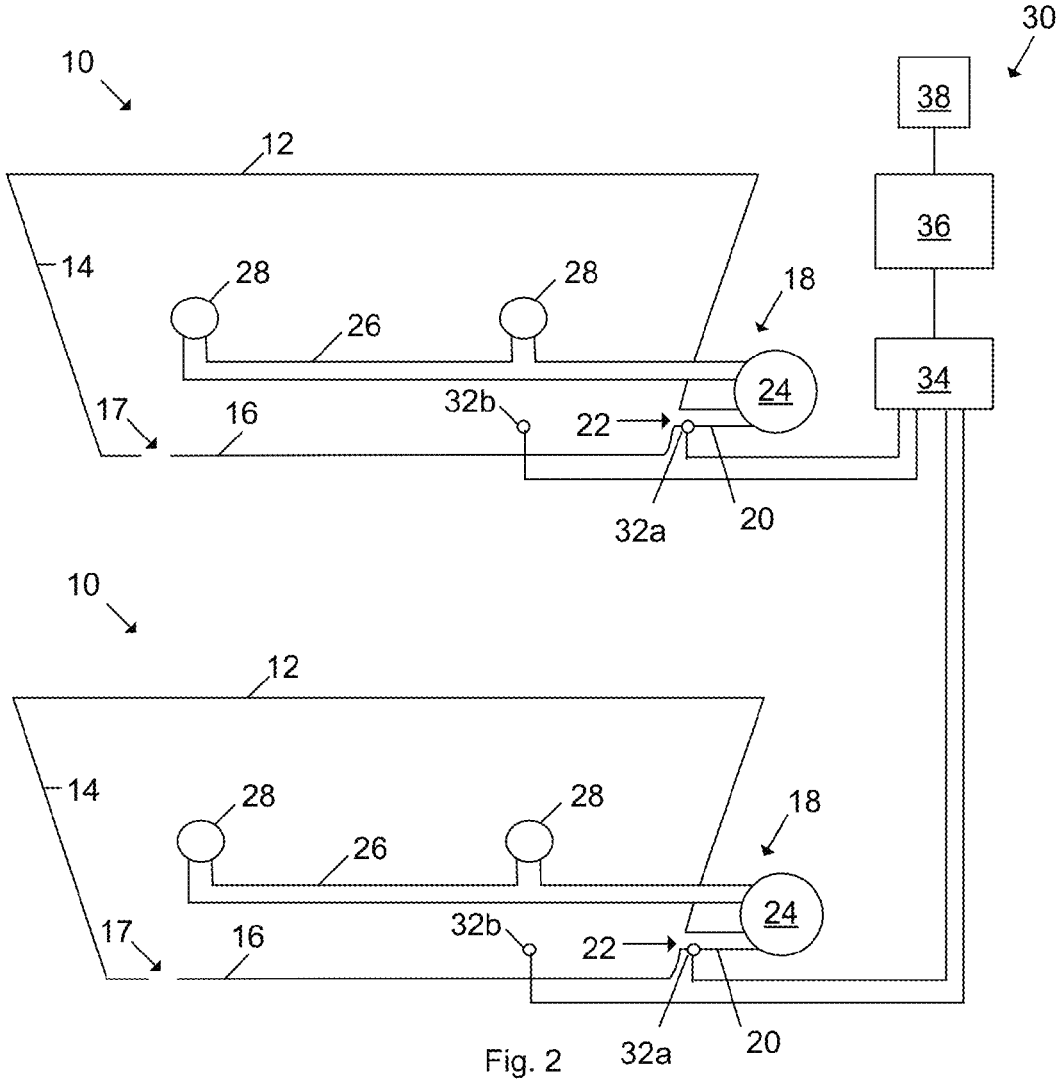
FIG. 2 is a schematic drawing of a plurality of tubs, each having a recirculation system and a detection system according to an exemplary embodiment.

With reference to FIG. 2, according to an exemplary embodiment, a usage detection system 30 is configured for use with multiple tubs 10 having recirculation systems 18, such as may be found in a hotel, spa, hospital, nursing home, etc. Sensors 32 are provided for each tub 10 and/or recirculation system 18 as described above, with each sensor 32 being in communication with one or more shared controllers 34. The controller 34 may communicate with an indicator 36 and user interface 38 provided for each tub 10. According to other exemplary embodiments, the controller 34 and indicator 36 may be configured in the different manners as described above, including by providing the controller 34 and indicator 36 as a computer and screen, which may display the usage state, cleaning state, or other information for each tub 10 and/or recirculation system 30. Advantageously, by associating multiple tubs 10 and recirculation systems 18 with a common controller 34 and indicator 36, central monitoring is provided, which may allow for more efficient or optimized use of resources, closer oversight of cleaning staff, and determination of usage patterns.

While the sensor 32, controller 34, indicator 36, and user interface 38 are discussed as separate devices or components having separate functionality, according to various exemplary embodiments, the sensor 32, controller 34, indicator 36, and user interface 38 and/or their respective functions may be consolidated, or further divided, into any suitable combination of devices and/or components that collectively function to detect a condition indicative of water in the recirculation system 18 and, accordingly, indicate a state of or other information related to the tub 10 and/or recirculation system 18. That is various combinations of the functions described (e.g., detecting, indicating, sending/receiving/processing signals) above may be performed by a single device or component, which may obviate the need to send/receive signals between the various components or devices. For example, functions of the controller 34, indicator 36, and user interface 38 may be integrated into a single object, such as a light that is a depressible button that may be turned on when a switch that is closed in response to a voltage received from the sensor 32 (i.e., turning on the light) and that is opened when depressed by a user (i.e., turning off the light). Further, division of the respective functions may require the need for various additional device or components and addition functions. It should be understood that these additional devices or components (e.g., sensors, controllers, indicators, and user interfaces) may be incorporated into the detection system 30 without departing from the scope of this disclosure. For example, the detection system 30 may include intermediate controllers, which are configured to receive signals from the sensor 32, process those signals, and accordingly send intermediate signals to the controller 34.

Figure 3:
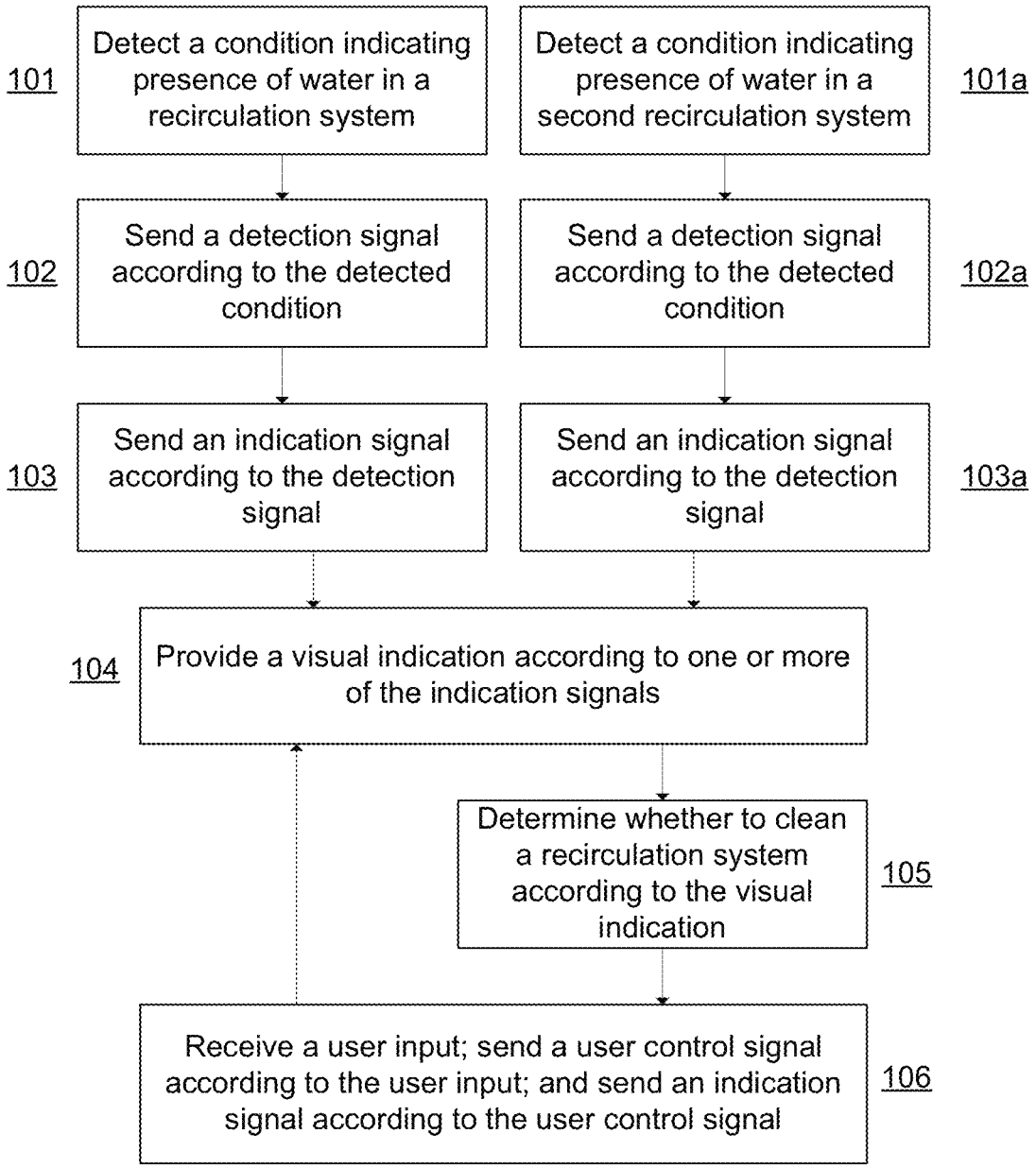
FIG. 3 is a flow chart depicting a method for indicating a state of water recirculation system of one or more tubs according to an exemplary embodiment.

Referring to FIG. 3, according to an exemplary embodiment, a method is provided for indicating a usage state, cleaning state, or other information related to a water recirculation system of a tub. The method generally includes: detecting a condition that indicates the presence of water in the water recirculation system with an electronic sensor (Step 101), and providing a visual indication that corresponds to the condition detected by the electronic sensor (Step 104). Intermediate steps may include: sending a detection signal from the electronic sensor to a controller according to the detected condition (Step 102), and sending an indication signal from the controller to a visual indicator according to the condition signal (Step 103). A subsequent step may include: determining whether to clean the tub and the recirculation system according to the visual indication (Step 105). A further subsequent step may include: sending a user control signal from a user interface to the controller, sending a second indicator signal according to the user control signal, and changing the visual indication according to the second indicator signal (Step 106). Additional steps may include repeating any of Steps 101-103 for a second water recirculation system of one or more tubs (Steps **101*a*-103*a***) and determining cleaning priority of the tubs and recirculation systems according to the visual indications thereof. Determining cleaning priority may, for example, be determined by the controller for display by the visual indicator.

According to an exemplary embodiment, the state of the water recirculation system may, for example, be a usage state, a cleaning state, or other information related to a state recirculation system. The at least one visual indication is provided with one or more of the visual indicators described above (e.g., light, computer screen, other type of display, etc.) The step of detecting a condition may include, for example, detecting that water has reached a predetermined height with a basin of the tub and/or detecting that water is present in an inlet line of the recirculation system according to a measurement or detected change in properties. The electronic sensor used in the step of detecting a condition may one or more of the sensors described above (e.g., capacitive, etc.).

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A detection system for a tub having a water recirculation system, the detection system comprising:

an electronic sensor configured to detect a condition indicative of water being present in a water recirculation system of a tub; and an indicator configured to provide a visual indication according to the detected condition.

2. The detection system of claim 1, wherein the electronic sensor is configured to send a detection signal according to the detected condition, and wherein the detection system further comprises a controller configured to receive the detection signal and send an indication signal according to the detection signal;

wherein the indicator is configured to receive the indication signal and provide the visual indication according to the detection signal.

3. The detection system of claim 1, wherein the electronic sensor is configured to detect whether water has reached a predetermined height within a basin of a tub.

4. The detection system of claim 3, wherein the electronic sensor is configured to couple to a wall of a basin of a tub.

5. The detection system of claim 1, wherein the electronic sensor is configured to detect whether water is present within an inlet tube of a water recirculation system.

6. The detection system of claim 5, wherein the electronic sensor is configured to couple to an inlet tube positioned between a water intake and a pump of a water recirculation system.

7. The detection system of claim 1, wherein the electronic sensor is one of a capacitive sensor, ultrasonic sensor, infrared sensor, resistive sensor, optical sensor, and temperature sensor.

8. The detection system of claim 1, wherein the indicator is a light, and the light is illuminated after detection of a condition indicative of water being present in a water recirculation system.

9. The detection system of claim 1, wherein the indicator is a screen, and the screen displays information a state of the condition indicative of water being present in a water recirculation system.

10. The detection system of claim 9, wherein the information displayed indicates whether a recirculation system requires cleaning.

11. The detection system of claim 1, further comprising:

a second electronic sensor configured to detect a second condition indicative of water being present in a second water recirculation system of a second tub;

wherein the indicator is configured to provide a second visual indication according to the second detected condition.

12. The detection system of claim 2, further comprising:

a second electronic sensor configured to detect a second condition indicative of water being present in a second water recirculation system of a second tub and to send a second detection signal according to the detected condition;

wherein the controller is configured to receive the second detection signal and to send a second indication signal according to the second detection signal; and wherein the indicator is configured to receive the second indication signal and provide a second visual indication according to the second detection signal.

13. A tub comprising:

a basin configured to hold water;

a water recirculation system configured to draw water from the basin and expel that water back into the basin; and a detection system comprising:

an electronic sensor configured to detect a condition indicative of water being present in the recirculation system; and an indicator configured to provide a visual indication according to the detected condition.

14. The tub of claim 13, wherein the electronic sensor is configured to send a detection signal according to the detected condition, and wherein the detection system further comprises a controller configured to receive the detection signal and send an indication signal according to the detection signal;

wherein the indicator is configured to receive the indication signal and provide the visual indication according to the detection signal.

15. The tub of claim 13, wherein the electronic sensor is coupled to a wall of the basin at a height corresponding to an intake of the water recirculation system.

16. The tub of claim 13, wherein the electronic sensor is coupled to an intake line of the water recirculation system.

17. The tub of claim 13, wherein the electronic sensor is configured to send a detection signal according to the detected condition to a controller that is configured to receive the detection signal and to receive a second detection signal from a second electronic sensor of a second tub.

18. A method for indicating a state of a water recirculation system of one or more tubs, the method comprising:

detecting with an electronic sensor the presence of water in a water recirculation system of a tub; and providing a visual indication that water has been detected in the water recirculation system by the electronic sensor.

19. The method of claim 18, further comprising:

sending a detection signal from the electronic sensor to a controller; and sending an indication signal from the controller to a visual indicator;

wherein the at least one visual indication is provided with a visual indicator according to the indication signal.

20. The method of claim 19, further comprising:

sending a user control signal from a user interface to the controller;

sending a second indicator signal from the controller to the visual indicator according to the user control signal; and changing the visual indication according to the second indicator signal.

21. The method of claim 18, wherein the electronic sensor is one of a capacitive sensor, ultrasonic sensor, infrared sensor, resistive sensor, optical sensor, and temperature sensor.

22. The method of claim 18, wherein detecting the presence of water in the water recirculation system includes at least one of detecting water reaching a certain height within a basin of the tub or detecting water being present in an inlet line of the recirculation system.

23. The method of claim 18, wherein the at least one visual indication corresponds to a usage state or a cleaning state.

24. The method of claim 18, further comprising:

detecting the presence of water in a second water recirculation system of a second tub with a second electronic sensor;

providing at least one visual indication that water has been detected in the second water recirculation system by the second electronic sensor.

* * * * *